US010139181B1

(12) United States Patent
Wild

(10) Patent No.: US 10,139,181 B1
(45) Date of Patent: Nov. 27, 2018

(54) CARRIER BOLT ASSEMBLY

(71) Applicant: Jonathan Wild, Lutz, FL (US)

(72) Inventor: Jonathan Wild, Lutz, FL (US)

( * ) Notice: Subject to any disclaimer, the term of this patent is extended or adjusted under 35 U.S.C. 154(b) by 0 days.

(21) Appl. No.: 15/691,664

(22) Filed: Aug. 30, 2017

(51) Int. Cl.
*F41A 21/00* (2006.01)
*F41A 19/59* (2006.01)
*F41A 3/12* (2006.01)

(52) U.S. Cl.
CPC ..... *F41A 19/59* (2013.01); *F41A 3/12* (2013.01)

(58) Field of Classification Search
CPC ..... F41A 19/58; F41A 19/69; F41A 19/70
USPC ..... 89/28.05
See application file for complete search history.

(56) References Cited

U.S. PATENT DOCUMENTS 4,730,407 A * 3/1988 DeCarlo ..... F41A 19/58 42/84
4,793,085 A * 12/1988 Surawski ..... F41A 19/58 42/1.05
5,755,056 A * 5/1998 Danner ..... F41A 3/22 42/84
6,397,508 B1 * 6/2002 Constant ..... F41A 9/65 42/69.01
2017/0089656 A1 * 3/2017 Alicea, Jr. ..... F41A 19/59

* cited by examiner

*Primary Examiner* — J. Woodrow Eldred
(74) *Attorney, Agent, or Firm* — Gulf Coast Intellectual Property Group

(57) ABSTRACT

A carrier bolt assembly that is configured to provide an electrical charge to execute the firing of a round of ammunition. The carrier bolt assembly includes a carrier that includes a bore substantially therethrough. Further present is a void adjacent to the bore. A conductive rod is mateably formed to be operably coupled and fixedly secured within the bore and void. The conductive rod includes an outer layer and an inner layer wherein the inner layer is configured to conduct an electric current through the conductive rod. The conductive rod includes a second section contiguous with a first section and further includes a mounting block. The mounting block has a knob formed thereon that is operably coupled with the inner layer of the conductive rod. The carrier bolt assembly further includes an extractor pin that includes a tapered shaped wherein the extractor pin is tapered towards the midsection.

18 Claims, 3 Drawing Sheets

CARRIER BOLT ASSEMBLY

FIELD OF THE INVENTION

The present invention relates generally to a firearm apparatus, more specifically but not by way of limitation, a carrier bolt assembly for a rifle such as but not limited to an AR-15, wherein the bolt carrier group includes a fixed insulated conductive rod operable to provide an electric current to discharge ammunition.

BACKGROUND

Firearms and the use thereof range from law enforcement, military and personal use. There are a vast array of types of firearms that can typically be categorized into two categories of handguns and long guns. Long guns include guns such as but not limited to rifles and shotguns. As is known in the art, rifles are most commonly manufactured in either a bolt action wherein the bolt is operated manually by the user or a semi-automatic wherein the bolt carrier group cycles automatically so as to load a new round of ammunition into the chamber for firing. One very common type of rifle is an AR-15. The AR-15 is a semi-automatic rifle that utilizes either gas or a rod to cycle the bolt carrier group during the firing of a round of ammunition. Conventional AR-15's utilize a firing pin to contact the bullet in order to provide the firing thereof.

While conventional firing pin technology has proven to be effective, there are drawbacks to utilizing this configuration. AR-15's are known to be a weapon that requires frequent cleaning. Gas operated carrier bolts result in the deposit of carbon and other contaminants into the firing chamber. This can result in firing pin malfunctions as well as other performance problems. Further, utilizing a firing pin configuration requires the use of a hammer, which results in a slightly longer cycle time and can potentially lead to accuracy issues. Electric caseless ammunition or electrically primed conventional ammunition has been shown to be desirable for eliminating lock time, which is the delay from trigger press to ammunition ignition.

Accordingly, there is a need for a carrier bolt assembly that includes a fixed insulated conductive rod that is operable to provide electronic ignition of ammunition disposed in the firing chamber of rifle such as but not limited to an AR-15.

SUMMARY OF THE INVENTION

It is the object of the present invention to provide a carrier bolt assembly configured to provide electrical ignition of a round of ammunition wherein the carrier includes a bore present therein wherein the bore includes a first end and a second end.

Another object of the present invention is to provide a carrier bolt assembly that is operable to provide electrical ignition of a round of ammunition that further includes a fixed conductive rod present in the bore of the carrier.

A further object of the present invention is to provide a carrier bolt assembly that is configured to provide electric ignition of a round of ammunition wherein the fixed conductive rod includes a first portion and a second portion wherein the first portion and second portion are integrally formed.

An additional object of the present invention is to provide a carrier bolt assembly operable to electrically ignite a round of ammunition that further includes an extractor pin wherein the extractor pin is formed in a specific shape so as to accommodate the second portion of the fixed conductive rod.

Yet a further object of the present invention is to provide a carrier bolt assembly group for an AR-15 that is configured to electrically ignite a round of ammunition wherein the fixed conductive rod includes a horizontal section and a vertical section.

A further object of the present invention is to provide a carrier bolt assembly operable to electrically ignite a round of ammunition wherein the first portion of the fixed conductive rod includes a mounting block being mateable in size to the rear portion of the bore of the carrier.

Another object of the present invention is to provide a carrier bolt assembly group for an AR-15 that is configured to electrically ignite a round of ammunition wherein the mounting block includes a knob configured to engage an electrical source such as but not limited to a contact switch.

Still an additional object of the present invention is to provide a carrier bolt assembly operable to electrically ignite a round of ammunition wherein the fixed conductive rod further includes a cylindrical portion adjacent to the mounting block and wherein the cylindrical portion has an aperture journaled therethrough.

Yet an alternative object of the present invention is to provide a carrier bolt assembly group for an AR-15 that is configured to electrically ignite a round of ammunition that further includes a securing rod wherein the securing rod is journaled through the aperture of the cylindrical portion so as to secure the fixed conductive rod to the carrier.

Another object of the present invention is to provide a carrier bolt assembly operable to electrically ignite a round of ammunition wherein the second end of the fixed conductive rod is rounded in shape.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
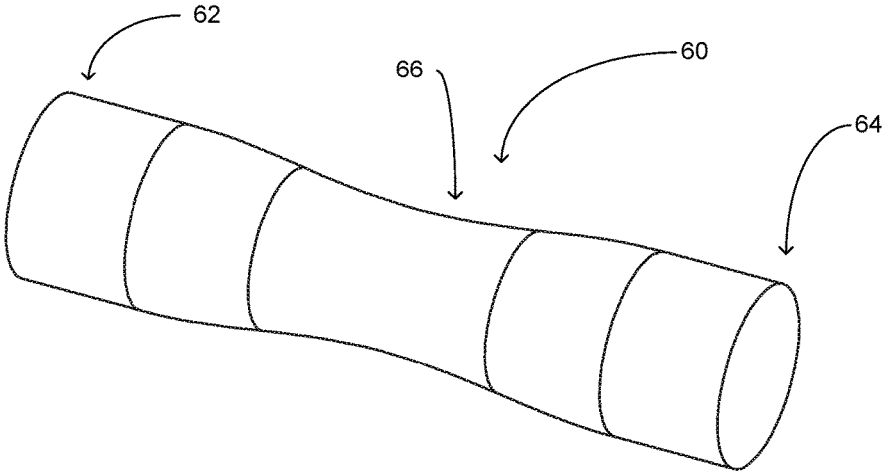
FIG. 1 is a perspective view of the extractor pin of the present invention.
Figure 2:
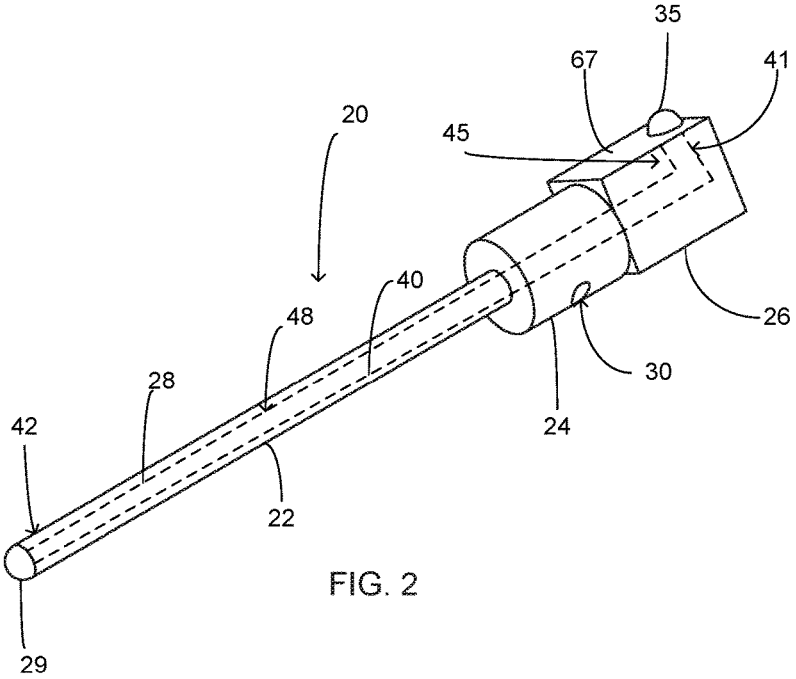
FIG. 2 is a perspective view of the conductive rod of the present invention.
Figure 3:
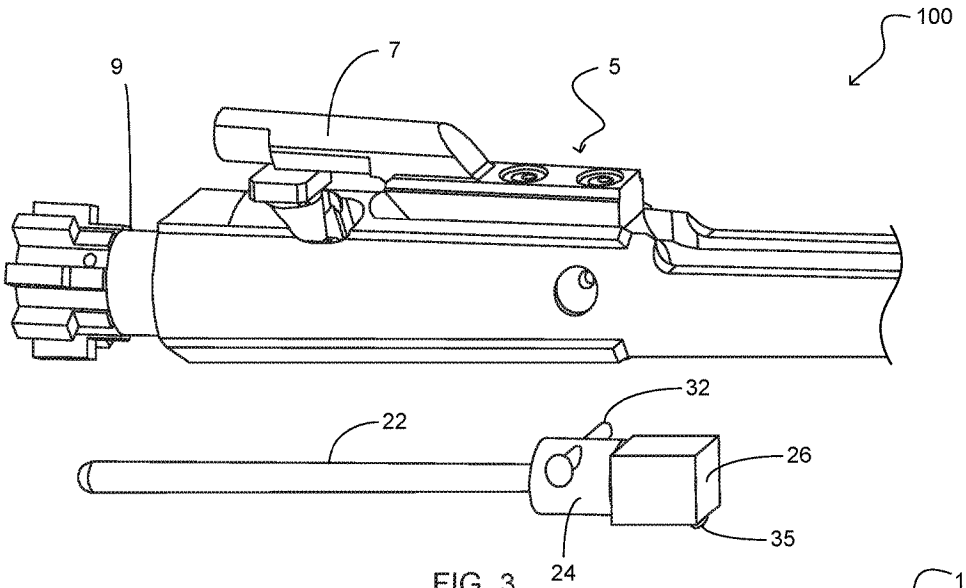
FIG. 3 is a perspective view of the carrier assembly and conductive rod of the present invention.

Referring now to the drawings submitted herewith, wherein various elements depicted therein are not necessarily drawn to scale and wherein through the views and figures like elements are referenced with identical reference numerals, there is illustrated a carrier bolt assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures herein, the carrier bolt assembly 100 includes a carrier 5 having an integrated gas key 7 and a bolt assembly 9. The carrier 5, integrated gas key 7 and bolt assembly 9 are conventional components for a carrier bolt assembly 100 and are manufactured similarly to conventional bolt carrier groups for AR-15 rifles. The carrier 5 includes bore 10 that extends through a portion of the carrier 5. The bore 10 includes a first portion 12 and a second portion 14 wherein the first portion 12 and second portion 14 are contiguously formed. The first portion 12 has a diameter that is consistent and is round in shape. The second portion 14 of the bore 10 includes a cylindrical section 16 and further includes an adjacent void 18 that is rectangular in shape.

The carrier bolt assembly 100 includes a conductive rod 20 that is configured to provide an electrical current to a round of ammunition for firing thereof. The conductive rod 20 is fixedly mounted within the carrier 5 specifically in the bore 10 thereof. The conductive rod 20 includes a first section 22, a second section 24 and a mounting block 26 wherein the first section 22, second section 24 and mounting block 26 are contiguously formed. The conductive rod 20 includes an outer layer 28 that in manufactured from an insulating material. The outer layer 28 inhibits the conducting of the electrical current passing through the conductive rod 20 from being conducted to the carrier 5. It is contemplated within the scope of the present invention that the outer layer 28 could be manufactured from numerous different materials configured to be capable of inhibiting electrical current from passing therethrough. The first section 22 of the conductive rod 20 is elongated in form and rod shaped so as to be mateably coupled with the first portion 12 of the bore 10. The first section 22 extends substantially the length of the bore 10 and includes end 29 that is rounded in form. End 29 is manufactured from a conductive material and is operable to be adjacent a round of ammunition and provide a current thereto so as to provide firing thereof. The end 29 is rounded in form so as to ensure reduced friction smoother operation during ejection of an ammunition case.

Distal to end 29 contiguously formed with the first section 22 is the second section 24. Second section 24 of the conductive rod 20 is a cylindrical in shape and is manufactured having a larger diameter than the first section 22. Second section 24 is operable to mateably fit into the cylindrical section 16 of the bore 10. The second section 24 further includes aperture 30. Aperture 30 is configured to receive securing rod 32 therethrough. Securing rod 32 is operable to releasably secure the conductive rod 20 within the carrier 5. Securing rod 32 is manufactured from a durable material such as but not limited to metal. While a securing rod 32 in conjunction with the aperture 30 has been illustrated herein as a technique for releasably securing the conductive rod 20 within the carrier 5, it is contemplated within the scope of the present invention that the conductive rod 20 could be releasably secured utilizing alternate techniques.

Contiguously formed with the second section 24 opposite the first section 22 is mounting block 26. Mounting block 26 is rectangular in shape and is formed so as to mateably engage the void 18 present in the rear of the carrier 5. Mounting block 26 provides an additional technique to ensure the conductive rod 20 is fixedly mounted within the carrier 5. Mounting block 26 includes knob 35 mounted on the lower surface 67 thereof. Knob 35 is configured to engage an electrical source 2 such as but not limited to a contact switch. The electrical source 2 has been illustrated herein diagrammatically. It should be understood by those skilled in the art that the electrical source 2 could include but not be limited to a battery. The knob 35 is manufactured from a suitable conductive material and is electrically coupled to the inner conductive layer 40 of the conductive rod 20. The knob 35 is electrically coupled to the first end 41 of the inner conductive layer 40. End 29 is electrically coupled to the second end 42 of the inner conductive layer 40. The knob 35 is integrally formed with mounting block 26 utilizing suitable manufacturing techniques and is rounded in shape so as to ensure smooth operation of the carrier 5 during the firing process eliminating any snagging thereof. While a specific structure of the conductive rod 20 has been illustrated and discussed herein, it is contemplated within the scope of the present invention that the conductive rod 20 could be formed in alternate manners in order to achieve the objective of being mateably and fixedly mounted within the bore 10 of the carrier 5.

The inner conductive layer 40 includes a vertical portion 45 and horizontal portion 48. The vertical portion 45 and horizontal portion 48 are contiguously formed and electrically coupled. The inner layer 40 is manufactured from a conductive material and is operable to transfer an electric current from knob 35 to end 29 in order to provide firing of a round of ammunition operably engaged with end 29. It is contemplated within the scope of the present invention that the inner conductive layer 40 could be manufactured from numerous different conductive materials in order to accomplish the desired objective of conducting an electric current to the end 29.

Figure 4:
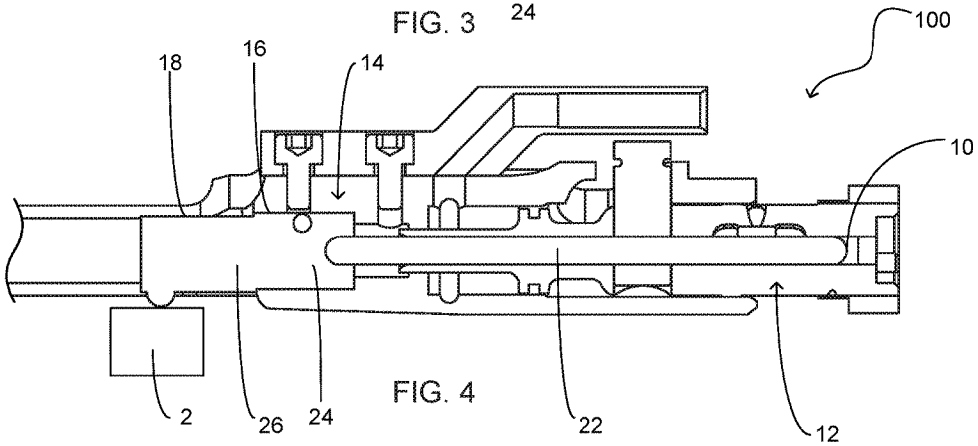
FIG. 4 is a cross-sectional view of the present invention in an assembled state.
Figure 5:
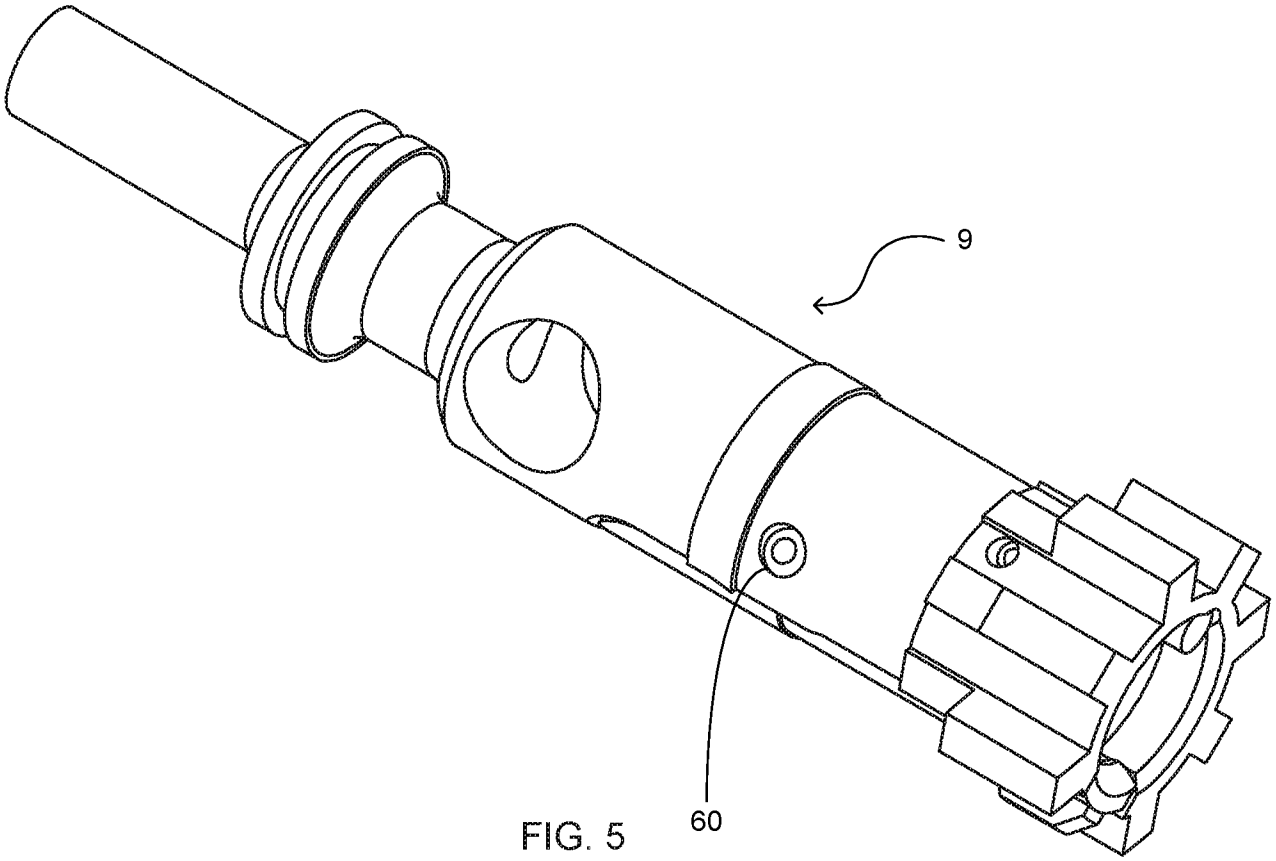
FIG. 5 is a perspective view of the bolt of the present invention.

Referring in particular to FIG. 4 herein, the extractor pin 60 of the present invention is illustrated therein. The extractor pin 60 is operably coupled to the carrier bolt 2 and is vertically adjacent the bore 10. Extractor pin 60 is manufactured from a suitable durable material such as but not limited to metal. As is known in the art, conventional extractor pins of AR-15's are configured to releasably secure an extractor. An extractor is configured to operably engage the rim of an ammunition case so as to assist in the ejection thereof subsequent firing a round of ammunition. The extractor pin 60 is vertically adjacent the bore 10 and as such the first section 22 of the conductive rod 20 present in the bore 10. The extractor pin 60 includes opposing end sections 62,64 being contiguous with midsection 66. The midsection 66 of the extractor pin 60 is tapered so as to have a diameter that is less than that of the diameter proximate the opposing end sections 62,64. The midsection 66 is formed in the aforementioned manner so as to accommodate the first section 22 of the conductive rod 20. Midsection 66 ensures that the extractor pin 60 does not penetrate into the bore 10 and inhibits engagement of the first section 22 of the conductive rod 20. This specific construction of the extractor pin 60 ensures the extractor pin 60 does not breach into the bore 10 so as to permit the first section 22 to be flush throughout the bore 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A carrier bolt assembly for a rifle comprising:

a carrier, said carrier having an integrated gas key, said carrier having a carrier bolt, said carrier having a bore, said bore having a first end and a second end, said carrier having a void proximate the first end of said bore;

a conductive rod, said conductive rod having an outer layer, said conductive rod having an inner layer, said conductive rod being mounted in said bore of said carrier, said conductive rod having a first section, said first section being disposed in said bore of said carrier, said first section having a first end and a second end, said outer layer of said conductive rod being manufactured from an insulative material, said inner layer being disposed within said outer layer, said inner layer being configured to conduct an electric current; and wherein said conductive rod is operably coupled to an electric power source and is operable to provide an electric current to said first end of said conductive rod in order to fire a round of ammunition adjacent thereto.

2. The carrier bolt assembly as recited in claim 1, wherein said conductive rod further includes a second section, said second section being contiguously formed with said first section, said second section being configured to mateably secure within at least a portion of the void of the carrier.

3. The carrier bolt assembly as recited in claim 2, and further including a mounting block, said mounting block being contiguous with said second section of said conductive rod, said mounting block operable to mateably secure within said void of said carrier.

4. The carrier bolt assembly as recited in claim 3, wherein said mounting block further includes a knob, said knob being electrically coupled to said inner layer of said conductive rod, said knob configured to engage the electric power source.

5. The carrier bolt assembly as recited in claim 4, and further including an extractor pin, said extractor pin being secured in said carrier bolt, said extractor pin having a midsection, wherein said extractor pin is manufactured to have a smaller diameter at said midsection.

6. The carrier bolt assembly as recited in claim 5, wherein said first end of said conductive rod is rounded in shape.

7. The carrier bolt assembly as recited in claim 6, wherein said second section of said conductive rod includes an aperture, said aperture being configured to receive a pin therethrough so as to assist in securing the conductive rod within the carrier.

8. A carrier bolt assembly configured to provide electrical ignition of a round of ammunition comprising:

a carrier, said carrier having an integrated gas key, said carrier having a carrier bolt, said carrier having a bore, said bore having a first end and a second end, said carrier having a void proximate the first end of said bore;

a conductive rod, said conductive rod being fixedly secured within said carrier, said conductive rod operable to provide an electric current to a round of ammunition so as to provide discharge thereof, said conductive rod having an outer layer, said outer layer of said conductive rod being manufactured from an insulative material, said conductive rod having an inner layer, said conductive rod being mounted in said bore of said carrier, said conductive rod having a first section, said first section being disposed in said bore of said carrier, said first section having a first end and a second end, said inner layer being disposed within said outer layer, said inner layer being configured to conduct an electric current, said conductive rod having a second section, said second section being contiguous with said first section, said second section being proximate said second end of said first section, said second section being cylindrical in shape, said second section having a diameter that is greater than that of said first section; and a mounting block, said mounting block being contiguous with said second section of said conductive rod opposite said first section, said mounting block having a lower surface, said mounting block operable to mateably secure within said void of said carrier.

9. The carrier bolt assembly as recited in claim 8, wherein said mounting block further includes a knob, said knob being formed on said lower surface of said mounting block, said knob being electrically coupled to said inner layer of said conductive rod.

10. The carrier bolt assembly as recited in claim 9, wherein said second section of said conductive rod further includes an aperture, said aperture configured to receive a securing rod therethrough so as to secure the conductive rod within the carrier bolt assembly.

11. The carrier bolt assembly as recited in claim 10, wherein said inner layer of said conductive rod includes a vertical portion and a horizontal portion, said vertical portion being present in said mounting block, said vertical portion operably coupled with said knob.

12. The carrier bolt assembly as recited in claim 11, and further including an extractor pin, said extractor pin being mounted within said carrier bolt, said extractor pin being adjacent said bore of said carrier, said extractor pin having a first end and a second end, said extractor pin further including a midsection, said extractor pin configured to taper inwards from said first end and said second end towards said midsection.

13. The carrier bolt assembly as recited in claim 12, wherein the diameter of said extractor pin at said midsection is less than that proximate said first end and said second end of said extractor pin.

14. A carrier assembly for an AR-15 that is configured to electrically discharge a round of ammunition comprising:

a carrier, said carrier having an integrated gas key, said carrier having a carrier bolt, said carrier having a bore, said bore having a first end and a second end, said carrier having a void proximate the first end of said bore;

a conductive rod, said conductive rod being fixedly secured within said carrier, said conductive rod operable to provide an electric current to a round of ammunition so as to provide discharge thereof, said conductive rod having an outer layer, said outer layer of said conductive rod being manufactured from an insulative material, said conductive rod having an inner layer, said conductive rod being mounted in said bore of said carrier, said conductive rod having a first section, said first section being disposed in said bore of said carrier, said first section having a first end and a second end, said inner layer being disposed within said outer layer, said inner layer of said conductive rod further including a vertical portion and a horizontal portion, said vertical portion, said inner layer being configured to conduct an electric current, said conductive rod having a second section, said second section being contiguous with said first section, said second section being proximate said second end of said first section, said second section being cylindrical in shape, said second section having a diameter that is greater than that of said first section, said second section of said conductive rod further including an aperture; and a mounting block, said mounting block being contiguous with said second section of said conductive rod opposite said first section, said mounting block having a lower surface, said mounting block operable to mateably secure within said void of said carrier, said mounting block further includes a knob, said knob being formed on said lower surface of said mounting block, said knob being electrically coupled to said inner layer of said conductive rod.

15. The carrier assembly as recited in claim 14, and further including a securing rod, said securing rod operable to be journaled through said aperture of said second section of said conductive rod.

16. The carrier assembly as recited in claim 15, and further including an extractor pin, said extractor pin being mounted within said carrier bolt, said extractor pin being mounted adjacent said bore of said carrier, said extractor pin having a first end and a second end, said extractor pin further including a midsection, said extractor pin configured to taper inwards from said first end and said second end towards said midsection such that the diameter of said extractor pin proximate said midsection is less than that proximate said first end and said second end.

17. The carrier assembly as recited in claim 16, wherein said first end of said first section of said conductive rod is rounded in shape.

18. The carrier assembly as recited in claim 17, wherein the mounting block os formed in a rectangular block.

* * * * *